US005925983A

United States Patent [19]

Toda et al.

[11] Patent Number: 5,925,983

[45] Date of Patent: Jul. 20, 1999

[54] CIRCUIT FOR INHIBITING THE SUPPLY OF POWER TO A DISCHARGE LAMP

[75] Inventors: Atsushi Toda; Masayasu Yamashita, both of Shimizu, Japan

[73] Assignee: Koito Manufacturing Co., Ltd., Tokyo, Japan

[21] Appl. No.: 08/833,020

[22] Filed: Apr. 3, 1997

[30] Foreign Application Priority Data

Apr. 4, 1996 [JP] Japan ..... 8-106460

[51] Int. Cl.[6] ..... H05B 37/00

[52] U.S. Cl. ..... 315/119; 315/127; 315/225

[58] Field of Search ..... 315/119, 123, 315/127, 128, 225, 120, 125, 224, 209 R, 226, 76, 77, 82, 83; 307/9.1, 10.1, 10.8

[56] References Cited

U.S. PATENT DOCUMENTS

| | | | |
|---|---|---|---|
| 5,068,570 | 11/1991 | Oda et al. | 315/128 |
| 5,140,229 | 8/1992 | Yagi et al. | 315/307 |
| 5,142,203 | 8/1992 | Oda et al. | 315/308 |
| 5,151,631 | 9/1992 | Oda et al. | 315/127 |
| 5,212,428 | 5/1993 | Sasaki et al. | 315/308 |
| 5,237,242 | 8/1993 | Takahashi et al. | 315/123 |
| 5,278,452 | 1/1994 | Matsumoto et al. | 307/10.8 |
| 5,295,036 | 3/1994 | Yagi et al. | 361/79 |
| 5,422,548 | 6/1995 | Yamashita et al. | 315/308 |
| 5,449,973 | 9/1995 | Yamashita et al. | 315/82 |
| 5,485,059 | 1/1996 | Yamashita et al. | 315/307 |
| 5,486,740 | 1/1996 | Yamashita et al. | 315/308 |
| 5,514,935 | 5/1996 | Oda et al. | 315/82 |
| 5,565,743 | 10/1996 | Yamashita et al. | 315/310 |
| 5,572,094 | 11/1996 | Yamashita et al. | 315/308 |

*Primary Examiner*—Don Wong
*Assistant Examiner*—David H. Vu
*Attorney, Agent, or Firm*—Sughrue, Mion, Zinn, Macpeak & Seas, PLLC

[57] ABSTRACT

A lighting circuit for a discharge lamp includes lighting control circuit for controlling the lighting of a discharge lamp, ignition means for supplying a trigger pulse to the discharge lamp and a socket. Power is supplied to the discharge lamp via terminals of the socket and terminals of a connector section of the discharge lamp. The socket and the connector section are respectively provided with connection terminals which are to be connected together while the discharge lamp is connected to the connecting member. When those connection terminals are not connected together, the supply of power and the supply of the trigger pulse to the discharge lamp are inhibited. This prevents problems (damaging insulation, an electric shock and the like) from arising when the lighting circuit is activated while the discharge lamp is not connected to the lighting circuit.

8 Claims, 5 Drawing Sheets

1
Power Supply
2
6
13
Lighting Control Means
3
Ignition Means
4
Discharge-Lamp Disconnection Detecting Means
5
Power Supply Circuit
14
7
8
8a
8b
11
11'

CIRCUIT FOR INHIBITING THE SUPPLY OF POWER TO A DISCHARGE LAMP

BACKGROUND OF THE INVENTION

1. Field of the Invention

The present invention relates to a novel discharge lamp lighting circuit, which inhibits the supply of power and a trigger pulse to a discharge lamp when an attempt is made to activate the lighting circuit while the discharge lamp is not connected to the lighting circuit.

2. Description of the Related Art

Recently, a compact discharge lamp (a metal halide lamp or the like) is receiving greater attention as a substitute light source for an incandescent lamp. It is known that a lighting circuit as adapted for a light source for a vehicular lamp, includes a DC power supply, a switching power supply circuit, a DC-AC converter, and an igniter circuit.

One known way to connect a discharge lamp to a lighting circuit is to connect a connector section of the discharge lamp to a socket which is to be connected to the output terminal of the lighting circuit, whereby power or a trigger pulse is supplied to the discharge lamp.

Since the supply voltage or trigger pulse to a discharge lamp to ignite it carries a high voltage, a high voltage is applied between connection terminals in the socket when the ignition switch is set on while the discharge lamp is not connected to the lighting circuit. If this state continues for a long period of time, the insulation of the socket may be damaged. If a worker forgets that the ignition switch has been set on and attempts to replace the discharge lamp, for example, the worker is likely to accidentally touch the connection terminals or the like of the socket and get an electric shock.

SUMMARY OF THE INVENTION

Accordingly, it is an objective of the present invention to provide a lighting circuit capable of preventing a problem from arising when an attempt is made to activate the lighting circuit while no discharge lamp is connected thereto.

To achieve this object, a lighting circuit for a discharge lamp according to this invention comprises lighting control means for controlling lighting of a discharge lamp and/or ignition means for supplying a trigger pulse to the discharge lamp; a connecting member having a power supply terminal to which a power supply terminal of the discharge lamp is to be connected and which is connected to an output line to the discharge lamp; and connection terminals respectively provided at the connecting member and a connector section of the discharge lamp to the connecting member, the connection terminals being connected to each other while the discharge lamp is connected to the connecting member, whereby power supply to the discharge lamp and/or supply of the trigger pulse to the discharge lamp is stopped or prohibited when the connection terminals are not connected together.

According to this invention, unless the connector section of the discharge lamp to the connecting member is connected to the connecting member, the connection terminals provided at the connector section and the connecting member are not connected together. This prevents the supply of power and the trigger pulse to the discharge lamp.

DETAILED DESCRIPTION OF THE PREFERRED EMBODIMENTS

The present invention will be described below with reference to FIGS. 1 through 4.

This invention is designed to supply the output of a lighting circuit and a trigger pulse to a discharge lamp through a connecting member to which the discharge lamp is to be connected, so that supply of power and the trigger pulse to the discharge lamp is stopped or inhibited when the discharge lamp is not connected to the connecting member.

The detection of the connection of the discharge lamp to the connecting member and the stopping or inhibition of the supply of power and the trigger pulse to the discharge lamp are accomplished by the following two ways.

(1) Means for positively detecting the disconnection of the discharge lamp from the connecting member is provided to stop or inhibit the supply of power and the trigger pulse to the discharge lamp.

(2) A method of designing the connecting member and the lighting circuit in such a manner as to inhibit the supply of power and the trigger pulse to the discharge lamp when the discharge lamp is not connected to the connecting member.

First, the scheme (1) may be accomplished by providing each of the connecting member and discharge lamp with a terminal for detecting their connection in addition to a power supply terminal, and determining if the connecting member is connected to the discharge lamp by utilizing the phenomenon that a detected voltage or detected current associated with the connection detecting terminals differs between the state where the discharge lamp is connected to the connecting member and the state where they are not connected.

Figure 1:
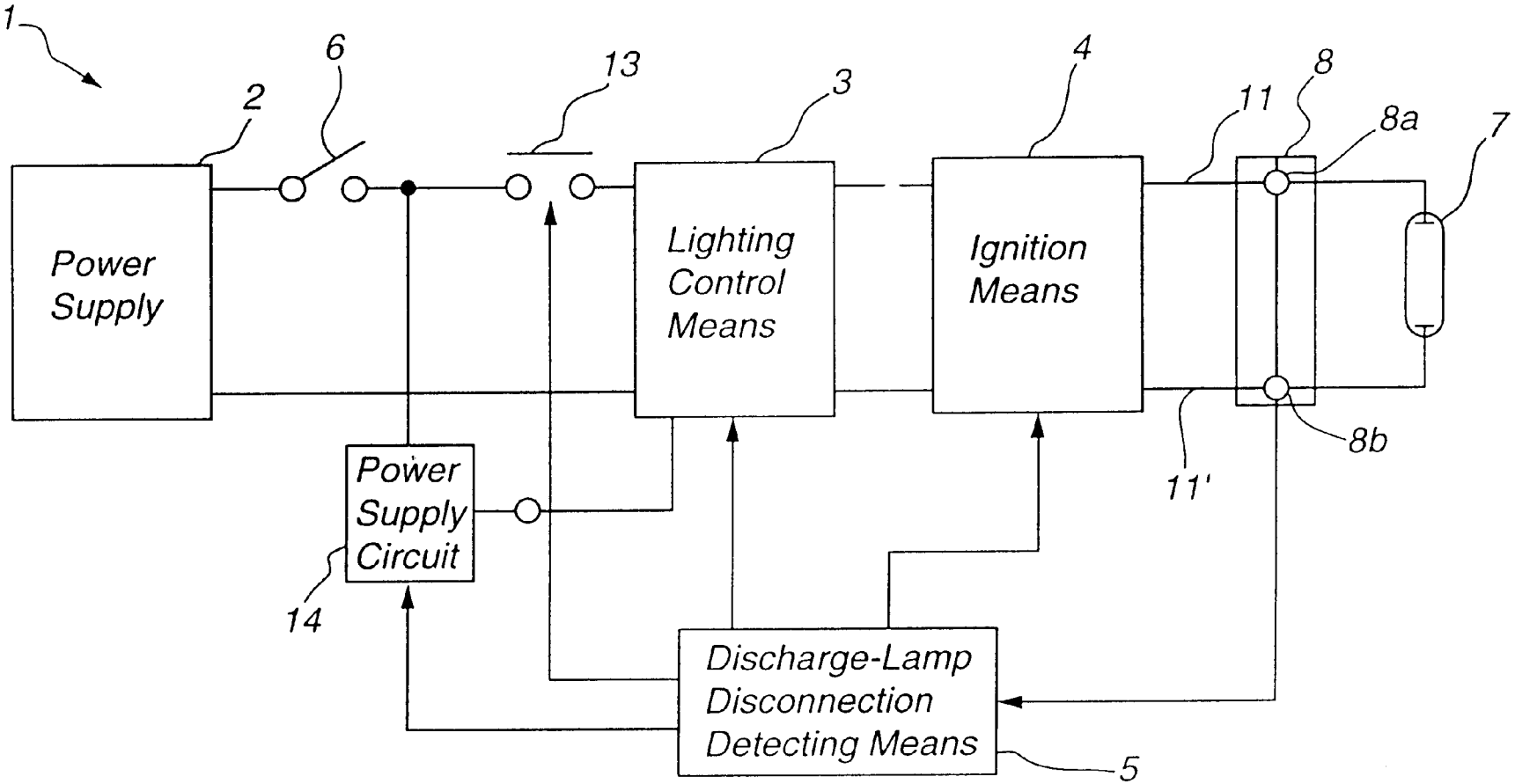
FIG. 1 is a circuit block diagram for explaining the structure of a lighting circuit for a discharge lamp in the case where means for positively detecting the disconnection of a discharge lamp from a connecting member is provided.

FIG. 1 illustrates the structure of a discharge lamp lighting circuit 1 which comprises a power supply 2, lighting control means 3, ignition means 4 and discharge-lamp disconnection detecting means 5.

A supply voltage produced by the power supply 2 is supplied via an ignition switch 6 to the lighting control means 3.

The lighting control means 3 is provided to mainly execute power control necessary for the lighting of a discharge lamp 7 based on the power supply 2. The output of the lighting control means 3 is sent via the ignition means 4 to the discharge lamp 7.

The ignition means 4 serves to generate a trigger pulse for the discharge lamp 7 in the initial lighting stage to ignite the discharge lamp 7.

A connecting member 8 (e.g., a socket or the like) to the discharge lamp 7 has power supply terminals 8*a* and 8*b* to which the output voltage of the ignition control means 3 and the trigger pulse from the ignition means 4 are supplied. The power supply terminals of the discharge lamp 7 are respectively connected to those terminals 8*a* and 8*b*.

The discharge-lamp disconnection detecting means 5 detects if the discharge lamp 7 is connected to the connecting member 8, supplies power and the trigger pulse to the discharge lamp 7 when the discharge lamp 7 is connected to the connecting member 8 and inhibits the supply of power and the trigger pulse to the discharge lamp 7 when the discharge lamp 7 is not connected to the connecting member 8.

Figure 2:
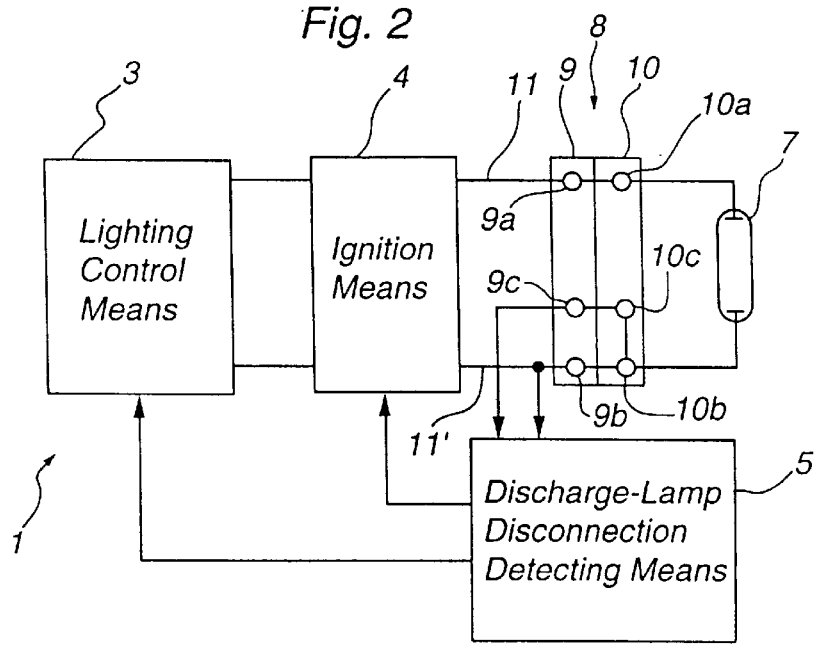
FIG. 2 is a circuit block diagram showing the structure of the essential portions.

As shown in FIG. 2, for example, a socket 9 constituting the connecting member 8 has terminals 9*a* and 9*b* inside as power supply terminals and a connection terminal 9*c* as a connection detecting terminal, and a connector section 10 of the discharge lamp 7 has terminals 10*a* and 10*b* inside also as power supply terminals and a connection terminal 10*c* as a connection detecting terminal.

That is, the terminals 9*a* and 9*b* in the socket 9 are respectively connected to output lines 11 and 11' of the lighting circuit 1, so that when the connector section 10 of the discharge lamp 7 is connected to the socket 9, the terminals 9*a* and 9*b* are respectively connected to the terminals 10*a* and 10*b*, thus supplying the output voltage of the lighting control means 3 and the trigger pulse generated by the ignition means to the discharge lamp 7. The connection terminal 10*c* of the connector section 10 is connected to the terminal 10*b* which is connected to, for example, the output line 11' so that when the connector section 10 and the socket 9 are connected together, the connection terminal 9*c* of the socket 9 is connected to the connection terminal 10*c* of the connector section 10.

The discharge-lamp disconnection detecting means 5 has one of its two input terminals connected to the connection terminal 9*c* and the other connected to the terminal 9*b*. The discharge-lamp disconnection detecting means 5 monitors a difference in the detected voltage or detected current between the state where the connector section 10 and the socket 9 are connected together and the state where they are not connected together, and stops power supply to the discharge lamp 7 or inhibits the supply of the trigger pulse thereto in accordance with the detection result.

The scheme (2) does not obtain a detection signal according to the connection state between the discharge lamp 7 and the connecting member 8, but is designed to disable the supply of power and the trigger pulse to the discharge lamp 7 when the discharge lamp 7 is not connected to the connecting member 8. This scheme may be accomplished by providing the connecting member 8 and the discharge lamp 7 with further terminals in addition to the power supply terminals, so that when the discharge lamp 7 is not connected to the connecting member 8, the power supply path to the discharge lamp 7, a circuit for generating the trigger pulse and a path for supplying the trigger pulse are cut off or disabled.

Figure 3:
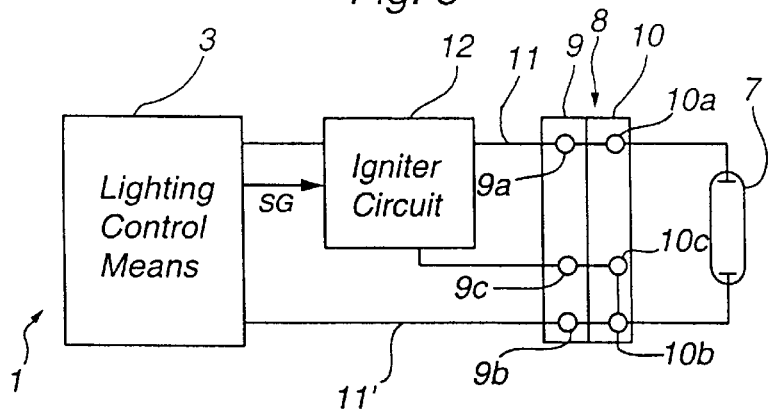
FIG. 3 is a circuit block diagram of the essential portions for explaining the structure which inhibits the supply of power and a trigger pulse to the discharge lamp when the discharge lamp is not connected to the connecting member.

As shown in FIG. 3, for example, the terminals 9*a* and 9*b* inside the socket 9 constituting the connecting member 8 and the terminals 10*a* and 10*b* inside the connector section 10 of the discharge lamp 7 serve as power supply terminals while the connection terminal 9*c* in the socket 9 and the connection terminal 10*c* in the connector section 10 serve to disable the circuit for generating the trigger pulse for the discharge lamp 7 when the socket 9 is not connected to the connector section 10.

An igniter circuit 12 is designed to superimpose the trigger pulse for the discharge lamp 7 on the output of the lighting control means 3 and apply the resultant pulse to the discharge lamp 7. The igniter circuit 12 has one input terminal supplied with a trigger pulse generating signal (hereinafter denoted by "SG") from the lighting control means 3 and the other input terminal connected to the connection terminal 9*c*. When the socket 9 is connected to the connector section 10, therefore, the latter input terminal of the igniter circuit 12 is connected to the output line 11' via the connection terminals 9*c* and 10*c* and the power supply terminal 10*b* to close the trigger pulse generating circuit. When the socket 9 is not connected to the connector section 10, however, the connection terminals 9*c* and 10*c* are not connected together, so that the trigger pulse generating circuit is not closed.

Figure 4:
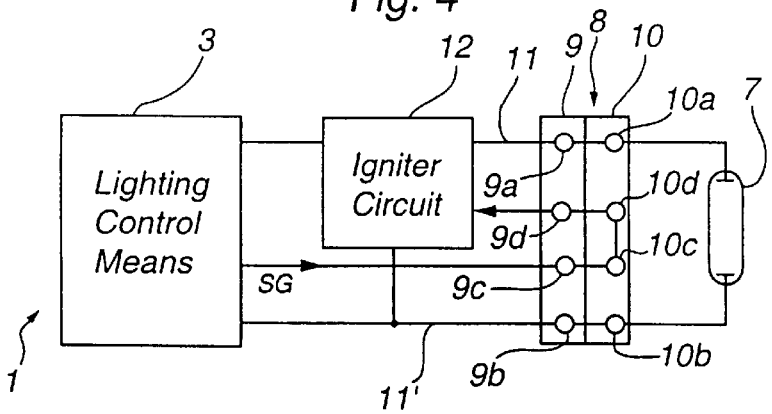
FIG. 4 is a circuit block diagram illustrating another structure different from the one shown in FIG. 3.

Although the trigger pulse generating signal SG from the lighting control means 3 is sent directly to the igniter circuit 12 in this example, this structure is not restrictive and may be modified as shown in FIG. 4. Specifically, the socket 9 and the connector section 10 are provided with new connection terminals 9*d* and 10*d* and the connection terminal 10*d* is connected to the connection terminal 10*c* to send the trigger pulse generating signal SG to the connection terminal 9*c* of the socket 9. When the socket 9 is connected to the connector section 10, the trigger pulse generating signal SG which is sent to the connection terminal 9*c* is supplied to the igniter circuit 12 from the connection terminal 9*d* via the connection terminals 10*c* and 10*d*. In this case, the other input terminal of the igniter circuit 12 is connected to an AC line 11'.

In those examples, the supply of the trigger pulse to the discharge lamp 7 alone is inhibited when the socket 9 is not connected to the connector section 10. This structure can of course be adapted to the inhibition of power supply to the discharge lamp. If the igniter circuit 12 in the structure shown in FIG. 4 is replaced with a circuit for cutting off the AC line 11 and the trigger pulse generating signal SG is used as a supply voltage to this line cutoff circuit, for example, the supply of the voltage to the terminal 9*c* is blocked to cut off the output line 11 when the socket 9 is not connected to the connector section 10.

Further, the scheme of inhibiting the supply of the trigger pulse to the discharge lamp 7 when the socket 9 is not connected to the connector section 10 and the scheme of stopping power supply to the discharge lamp 7 may be combined. In this case, power supply to the discharge lamp 7 may be positively stopped by the following schemes:

(I) To cut off power supply to the lighting control means 3 from the power supply 2.

(II) To stop the operation of the lighting control means 3.

With regard to the scheme (I), switch means 13 may be provided between the power supply 2 and the lighting control means 3 as shown in, for example, FIG. 1, so that when the discharge lamp 7 is not connected to the connecting member 8, the switch means 13 is opened to cut off power supply to the lighting control means 3.

The scheme (II) may be accomplished by disabling power control for the discharge lamp 7, a voltage conversion process or the like in response to a signal which is sent to the lighting control means 3 from the discharge-lamp disconnection detecting means 5, or by stopping the operation of a power supply circuit 14 which supplies voltages needed for the components of the lighting control means 3 or making the supply voltage from the power supply circuit 14 to zero.

Figure 5:
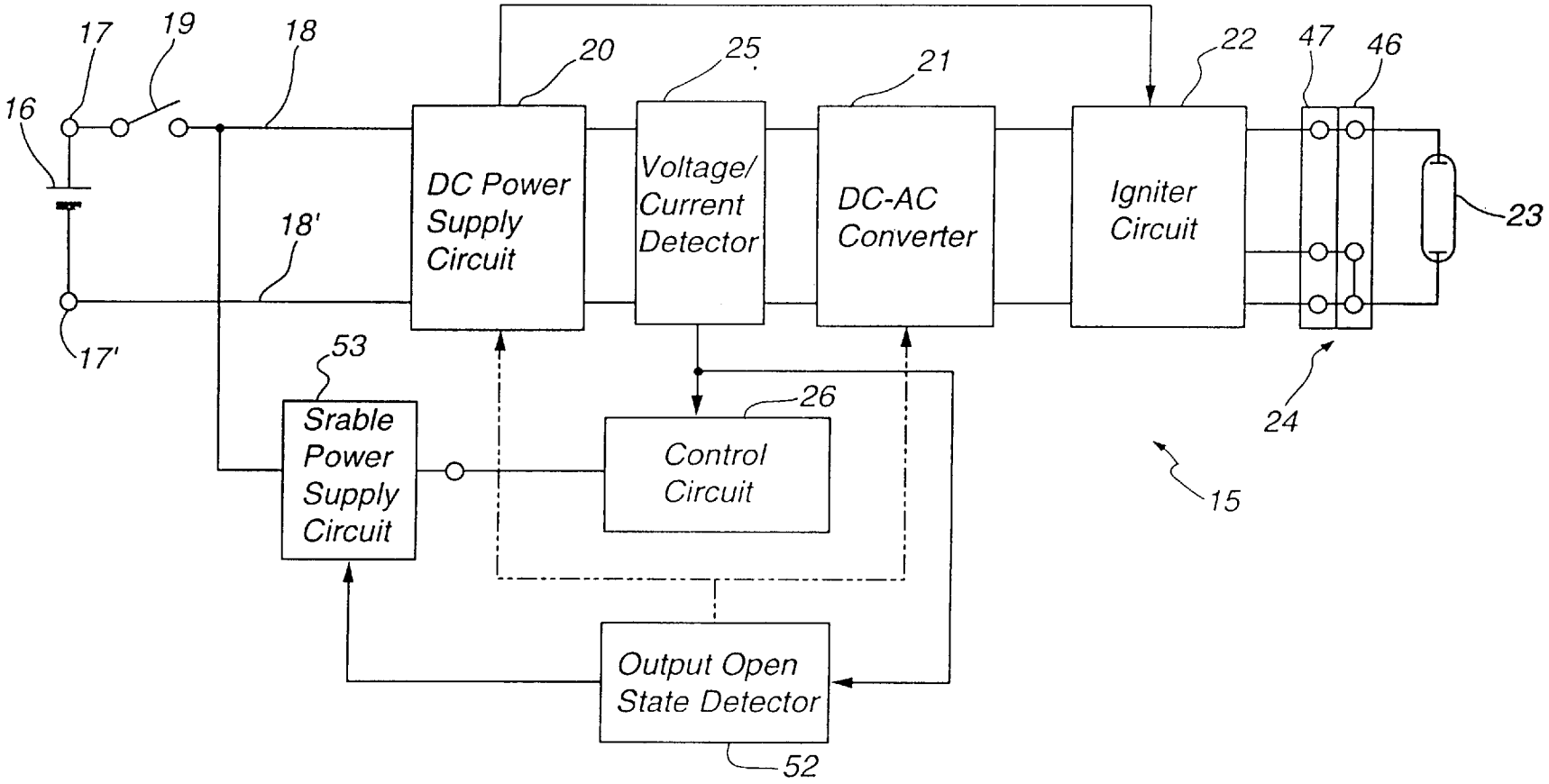
FIG. 5 is a circuit block diagram illustrating the first embodiment of this invention.
Figure 6:
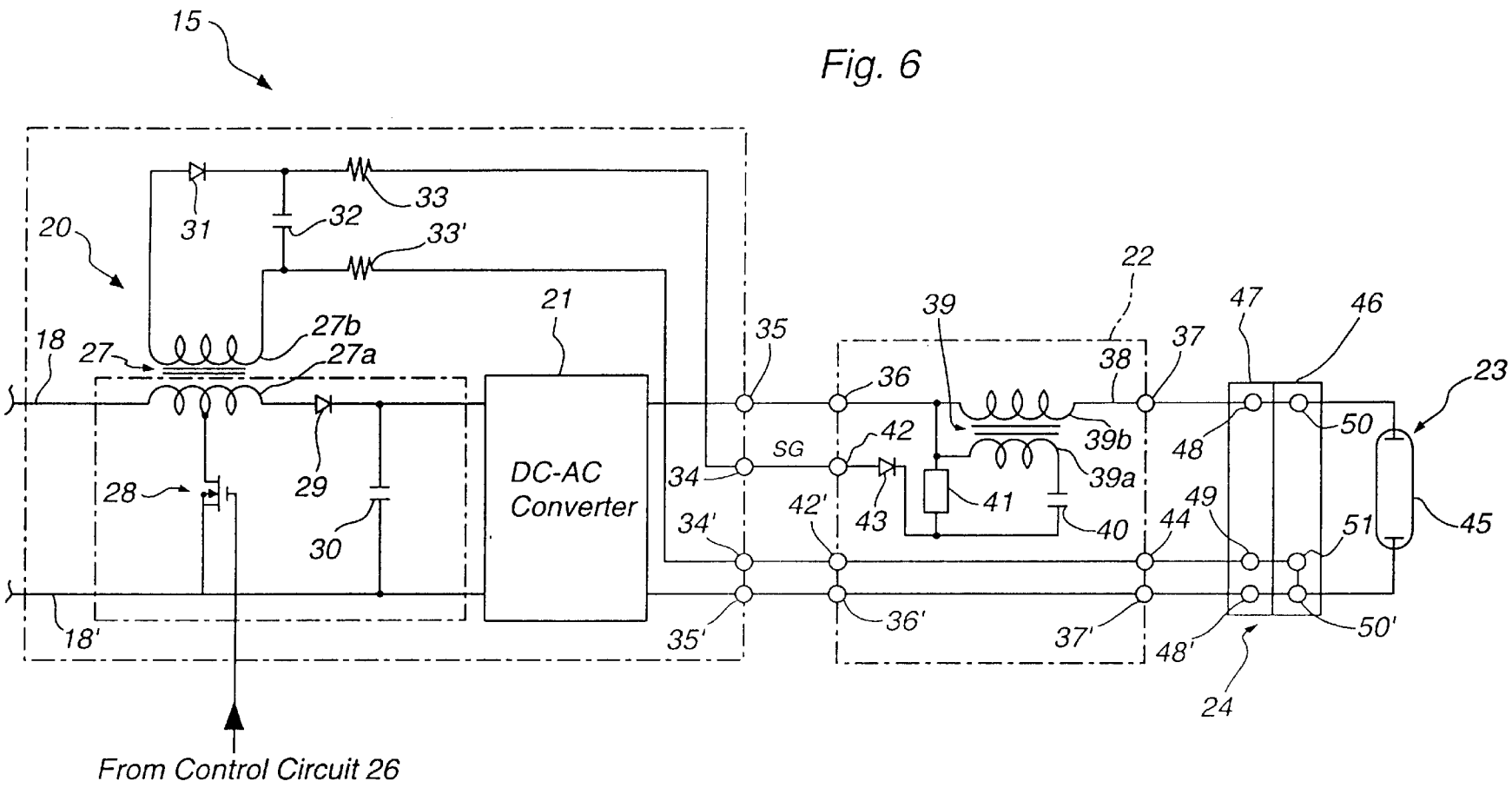
FIG. 6 is a circuit block diagram showing the structure of the essential portions of this embodiment.

FIGS. 5 and 6 illustrate the first embodiment of this invention.

In a lighting circuit 15, a battery 16 equivalent to the aforementioned power supply 2 is connected between input terminals 17 and 17' and an ignition switch 19 is provided on one (18) of DC power lines 18 and 18'.

A DC power supply circuit 20 to which the battery voltage is input, boosts and/or reduces the battery voltage and sends its output to a DC-AC converter 21 located at the subsequent stage. It is to be noted that the DC power supply circuit 20 sends a voltage signal (equivalent to the aforementioned signal SG) necessary for the generation of the trigger pulse to an igniter circuit which will be discussed later.

The DC-AC converter 21 converts the DC voltage output from the DC power supply circuit 20 to an AC voltage. For example, the DC-AC converter 21 may be designed to comprise a bridge circuit having plural pairs of semiconductor switch elements positioned on the power supply path to a discharge lamp 23 and a drive controller for driving this bridge circuit.

An igniter circuit 22, located at the subsequent stage of the DC-AC converter 21, generates a trigger pulse to the discharge lamp 23, superimposes this trigger pulse onto the output of the DC-AC converter 21, and applies the resultant signal to the discharge lamp 23 via a connecting member 24. The igniter circuit 22 is equivalent to the aforementioned ignition means 4.

Provided between the DC power supply circuit 20 and the DC-AC converter 21 is a voltage/current detector 25 for detecting the output voltage and output current of the DC power supply circuit 20. The voltage/current detector 25 sends a detection signal to a control circuit 26.

The control circuit 26 generates a control signal according to the detection signal from the voltage/current detector 25, and sends the control signal to the DC power supply circuit 20 to control the output voltage thereof. In this manner, the control circuit 26 performs power control which matches with the ignition state of the discharge lamp 23 to shorten the ignition time and re-ignition time and stably light the discharge lamp 23 in the steady lighting mode. The control circuit 26 can take any structure like a pulse width modulation type structure.

FIG. 6 exemplifies the structures of the essential portions of the lighting circuit 15.

The DC power supply circuit 20 has the structure of a chopper type DC—DC converter and includes a transformer 27, an N channel FET 28, a diode 29 and a capacitor 30.

The transformer 27 has a primary winding 27*a* provided on a DC power line 18. The FET 28 has a drain connected to a midway of the primary winding 27*a* and a source connected to a DC power line 18'. A control signal whose duty cycle changes is sent to the gate of the FET 28 from the control circuit 26.

The diode 29 is provided on the DC power line 18 at the subsequent stage of the primary winding 27*a*, and the capacitor 30 is provided between the cathode of the diode 29 and the DC power line 18'.

The terminal voltage of the secondary winding, 27*b*, of the transformer 27 is sent to a circuit which includes a diode 31 and a capacitor 32. The terminal voltage of the capacitor 32 is sent via resistors 33 and 33' to terminals 34 and 34' from which it is supplied to the igniter circuit 22.

The two output terminals of the DC-AC converter 21 are respectively connected to terminals 35 and 35' which are respectively connected to the input terminals, 36 and 36', of the igniter circuit 22.

In the igniter circuit 22, the secondary winding, 39*b*, of a trigger transformer 39 is provided on a line 38 which connects the input terminal 36 of the igniter circuit 22 to an output terminal 37 thereof, and one ends of the primary winding 39*a* and secondary winding 39*b* of a trigger transformer 39 are both connected to the input terminal 36. A capacitor 40 is connected in series to the primary winding 39*a*, and a trigger element 41 is connected in parallel to the primary winding 39*a* and the capacitor 40.

Terminals 42 and 42' are respectively connected to the terminals 34 and 34'. The terminal 42 is connected to the anode of a diode 43 whose cathode is connected between the trigger element 41 and the capacitor 40. The other terminal 42' is connected directly to a connection terminal 44 to a socket 47 which will be discussed later.

Note that the output terminal 37' of the igniter circuit 22 is connected to the input terminal 36'.

The discharge lamp 23 has an arc tube 45 and a connector section 46, and is designed to receive power or the trigger pulse from the lighting circuit 15 when the connector section 46 is connected to the socket 47.

Three terminals 48, 48' and 49 are provided in the socket 47. The terminals 48 and 48', which serve to supply power and the trigger pulse to the discharge lamp 23, are respectively connected to the output terminals 37 and 37' of the igniter circuit 22. The connection terminal 49 is provided to close the circuit for generating the trigger pulse to the discharge lamp 23 when it is connected to the connection terminal 44 of the igniter circuit 22.

Terminals 50, 50' and 51, which respectively associated with the terminals 48, 48' and 49, are provided in the connector section 46 of the discharge lamp 23. When the connector section 46 of the discharge lamp23 is connected to the socket 47, the terminals 50 and 50' are respectively connected to the terminals 48 and 48', and the connection terminal 51 connected to the terminal 50' is connected to the connection terminal 49. A pair of electrodes of the arc tube 45 are respectively connected to the terminals 50 and 50'.

As the connection terminals 49 and 51 are connected together with the connector section 46 of the discharge lamp 23 connected to the socket 47 in the lighting circuit 15, the trigger pulse generating circuit in the igniter circuit 22 is closed.

As the ignition switch 19 is set on, the battery voltage is sent via the DC power supply circuit 20 to the DC-AC converter 21 to be converted to an AC voltage (e.g., a square voltage). A voltage slightly lower than the operational voltage of the trigger element 41 is produced in the capacitor 32 until the discharge lamp 23 is lit. The capacitor 40 is charged with this voltage via the diode 43 of the igniter circuit 22. When the terminal voltage of the capacitor 40 reaches the operational voltage of the trigger element 41, the trigger element 41 is enabled to generate a pulse on the primary winding 39*a* of the trigger transformer 39 and a boosted pulse on the secondary winding 39*b* is superimposed on the output voltage of the DC-AC converter 21. The resultant signal is supplied to the discharge lamp 23 to activate the lamp 23.

When the connector section 46 of the discharge lamp 23 is not connected to the socket 47, the connection terminals 49 and 51 are not connected together so that the trigger pulse generating circuit in the igniter circuit 22 is not closed. That is, the charge path for the capacitor 40 of the igniter circuit 22 is cut off to block the flow of the charge current, so that the trigger pulse for the discharge lamp 23 is not generated.

Since the supply voltage to the discharge lamp 23 is supplied to the terminals 48 and 48' of the socket 47 in this case, it is desirable to provide a circuit which detects the open status of those terminals 48 and 48' and stops supplying the supply voltage to the discharge lamp 23 upon detection of the open state.

As shown in FIG. 5, for instance, an output open status detector 52 is provided, the levels of a detected voltage and a detected current, which are obtained by the voltage/current detector 25 and are equivalent to the lamp voltage and the lamp current of the discharge lamp 23, are compared with each other to determine if the discharge lamp 23 is connected to the socket 47. When the connector section 46 of the discharge lamp 23 is not connected to the socket 47, power supply to the discharge lamp should be stopped. The power supply to the discharge lamp 23 can be disabled by stopping the operation of a stable power supply circuit 53 which supplies the supply voltage necessary for the control circuit 26 and the other circuits. This scheme of stopping the operation of the stable power supply circuit 53 and the supply voltage can suppress a current change when the operation or the supply of the supply voltage is stopped, as compared with the scheme of stopping power supply to the DC power supply circuit 20 from the battery 16. The former scheme can thus allow the use of elements having a smaller breakdown current and a smaller heat resistance and is advantageous over the latter scheme in cost reduction.

Figure 7:
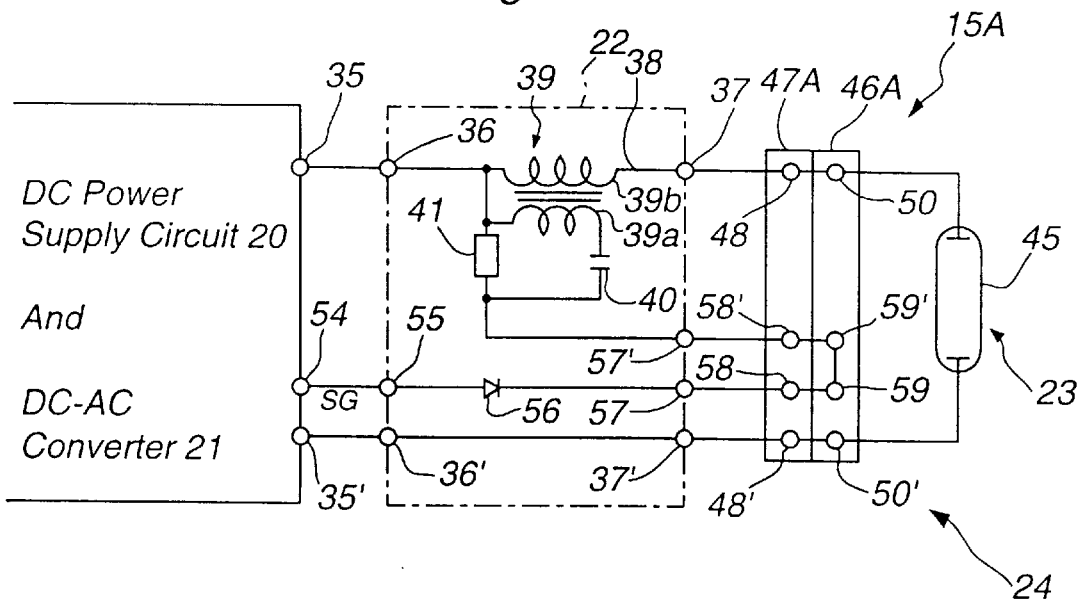
FIG. 7 is a circuit block diagram depicting the essential portions of the second embodiment of this invention.

FIG. 7 illustrates the structure of the essential portion of the second embodiment of this invention. As the second embodiment is mostly the same as the first embodiment, like or same reference numerals are given to those components which are the same as the corresponding components of the first embodiment and their description will not be repeated. The same is true of the description of the third embodiment which will follow shortly.

A lighting circuit 15A according to the second embodiment is provided with a terminal 54 for charging the capacitor 40 in the igniter circuit 22 in addition to the terminals 35 and 35' to which the output terminals of the DC-AC converter 21 are connected. The terminal 54 is connected to a terminal 55 of the igniter circuit 22, which is further connected to a terminal 57 via a diode 56 whose bias direction is toward the discharge lamp 23. In the primary side circuit of the trigger transformer 39, the trigger element 41 is connected in parallel to the series circuit of the primary winding 39*a* and the capacitor 40 with a terminal 57' connected between the trigger element 41 and the capacitor 40.

Four terminals 48, 48', 58 and 58' are provided in a socket 47A, the last two terminals 58 and 58' being respectively connected to the terminals 57 and 57' of the igniter circuit 22.

Terminals 50, 50', 59 and 59' respectively associated with the terminals 48, 48', 58 and 58' are provided in a connector section 46A of the discharge lamp 23. The terminals 59 and 59' are connected to the respective terminals 58 and 58' when the connector section 46A of the discharge lamp 23 is connected to the socket 47A. The terminals 59 and 59' are connected together in the connector section 46A.

In this lighting circuit 15A, while the connector section 46A of the discharge lamp 23 is connected to the socket 47A, the terminals 58 and 58' are respectively connected to the terminals 59 and 59' to close the trigger pulse generating circuit in the igniter circuit 22. In other words, the trigger pulse generating signal SG is supplied to the capacitor 40 in the igniter circuit 22 to charge the capacitor 40 in the route from the terminal 54, to the diode 56 and to the terminal 57' through the terminals 57, 58, 59, 59' and 58', and the trigger pulse is generated when the terminal voltage of the capacitor 40 reaches the operational voltage of the trigger element 41. With the connector section 46A of the discharge lamp 23 disconnected from the socket 47A, the terminals 58 and 58' are not connected to the respective terminals 59 and 59' so that the trigger pulse generating circuit in the igniter circuit 22 is not closed. That is, the charge path for the capacitor 40 of the igniter circuit 22 is cut off to block the flow of the charge current so that the trigger pulse for the discharge lamp 23 is not generated.

Figure 8:
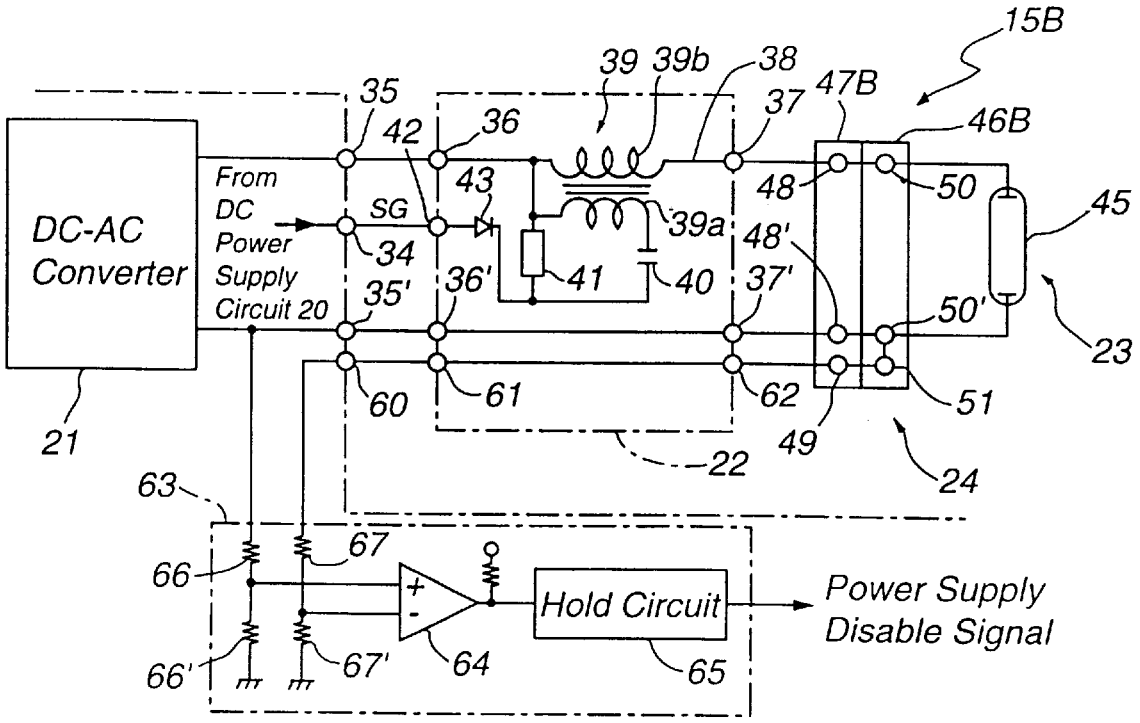
FIG. 8 is a circuit block diagram depicting the essential portions of the third embodiment of this invention.

FIG. 8 illustrates the structure of the essential portion of a lighting circuit 15B according to the third embodiment of this invention, which is designed to stop power supply to the discharge lamp when the discharge lamp is not connected to the socket.

Besides the terminals 35 and 35', terminals 34 and 60 are provided at the output stage of the DC-AC converter 21. The terminal 34, which is provided to charge the capacitor 40 in the igniter circuit 22 as mentioned earlier, is connected to the terminal 42 of the igniter circuit 22. The terminal 60, which is for detecting the connection or disconnection of the discharge lamp 23 to or from a socket 47B, is connected to a terminal 61 of the igniter circuit 22. The terminal 61 is connected to a connection terminal 62 of the igniter circuit 22 to the socket 47B.

The socket 47B and a connector section 46B of the discharge lamp 23 both have three connection terminals as in the first embodiment. When the socket 47B is connected to the connector section 46, the terminals 48 and 48' are respectively connected to the terminals 50 and 50' and the connection terminals 62 and 49 are connected together. The terminals 50' and 51 are connected at the connector section 46B.

A discharge-lamp disconnection detector 63 has a comparator 64 and a hold circuit 65, and compares the potentials at the terminals 35' and 60 with each other.

A voltage obtained by dividing the voltage at the terminal 35' by resistors 66 and 66' is input to the positive input terminal of the comparator 64, while a voltage obtained by dividing the voltage at the terminal 60 by resistors 67 and 67' is input to the negative input terminal of the comparator 64. The resistances of those voltage dividing resistors 66, 66', 67 and 67' are set in such a way that the potential at the negative input terminal of the comparator 64 becomes higher than the potential at the positive input terminal thereof when the connector section 46B of the discharge lamp 23 is connected to the socket 47B. Therefore, the comparator 64 outputs an L (Low) signal when the connector section 46B is connected to the socket 47B and outputs an H (High) signal when the connector section 46B and the socket 47B are not connected together.

The hold circuit 65 holds the H signal output from the comparator 64 and uses this held signal as a signal to stop power supply to the discharge lamp 23. That is, when the H signal is sent to the stable power supply circuit 53 from the hold circuit 65, the operation of the stable power supply circuit 53 is stopped to inhibit power supply to the discharge lamp 23.

In the lighting circuit 15B, when the connector section 46B of the discharge lamp 23 is connected to the socket 47B, a path running from the terminal 35' to the terminal 60 through the terminals 36', 37', 48', 50', 51, 49, 62 and 61 is formed and the potential at the negative input terminal of the comparator 64 becomes greater than the potential at the positive input terminal thereof. As a result, the comparator 64 outputs an L signal. Thus, the hold circuit 65 also outputs an L signal so that the operation of the stable power supply circuit 53 is not stopped, thereby allowing power to be supplied to the discharge lamp 23.

When the connector section 46B of the discharge lamp 23 is not connected to the socket 47B, the terminals 48' and 49 are open so that the aforementioned path is not formed. Consequently, the potential at the positive input terminal of the comparator 64 becomes greater than the potential at the negative input terminal thereof and the comparator 64 outputs an H signal. Thus, the hold circuit 65 also outputs an H signal to stop the operation of the stable power supply circuit 53. This inhibits power supply to the discharge lamp 23.

Although the output signal of the hold circuit 65 is used to stop power supply to the discharge lamp, it may be used to stop or disable the trigger pulse to the discharge lamp.

According to the first aspect of this invention, as apparent from the foregoing description, unless the connector section of the discharge lamp to the connecting member is connected to the connecting member, the connection terminals provided at the connector section and the connecting member are not connected together so that the supply of power and the trigger pulse to the discharge lamp is not permitted. This prevents problems (damaging insulation, an electric shock and the like) from arising when the lighting circuit is activated while the discharge lamp is not connected to the lighting circuit.

According to the second aspect of this invention, the supply of power and the trigger pulse to the discharge lamp is not permitted when the discharge-lamp disconnection detecting means detects the disconnection of the connector section of the discharge lamp to the connecting member. This prevents problems from arising when the lighting circuit is activated while the discharge lamp is not connected to the lighting circuit.

According to the third aspect of this invention, when the discharge lamp is not connected to the connecting member, the trigger pulse generating path in the ignition means is not closed so that no trigger pulse is supplied to the discharge lamp in this state.

According to the fourth aspect of this invention, when the discharge lamp is not connected to the connecting member, the discharge-lamp disconnection detecting means stops the operation of the lighting control means or stops supplying the supply voltage and/or the reference voltage necessary for the circuit operation to protect the lighting circuit.

What is claimed is:

1. A lighting circuit for a discharge lamp comprising:

ignition means for supplying a trigger pulse to said discharge lamp;

lighting control means for controlling lighting of said discharge lamp and said ignition means;

a connecting member, connected to said lighting control means, having power supply terminals to which power supply terminals of said discharge lamp are connected and a first connection terminal;

said discharge lamp comprising a second connection terminal, said first and second connection terminals being connected to each other such that said discharge lamp is connected to said connecting member, wherein power supply to said discharge lamp and supply of said trigger pulse to said discharge lamp are inhibited when said first and second connection terminals are not connected together.

2. The lighting circuit according to claim 1, wherein a portion of said ignition means is connected to said first connection terminal provided at said connecting member, and wherein a trigger pulse generation path in said ignition means is closed when said discharge lamp is connected to said connecting member.

3. The lighting circuit according to claim 2, wherein said ignition means comprises charge means, provided on said trigger pulse generation path, for generating said trigger pulse.

4. The lighting circuit according to claim 3, wherein said charge means is charged via a line different from said output line and connected to said lighting control means.

5. A lighting circuit for a discharge lamp comprising:

ignition means for supplying a trigger pulse to said discharge lamp;

lighting control means for controlling lighting of a discharge lamp and said ignition means;

a connecting member, connected to said lighting control means, having power supply terminals to which power supply terminals of said discharge lamp are connected and a first connection terminal;

said discharge lamp comprising a second connection terminal, said first and second connection terminals being connected to each other; and discharge-lamp disconnection detecting means for detecting when said discharge lamp is connected to said connecting member in accordance with a connection state of said first and second connection terminals, wherein power supply to said discharge lamp and supply of said trigger pulse to said discharge lamp are inhibited when disconnection of said discharge lamp from said connecting member is detected by said discharge-lamp disconnection detecting means.

6. The lighting circuit according to claim 5, wherein at least one of operation of said lighting control means is terminated and a supply of a reference voltage necessary for said operation is terminated when disconnection of said discharge lamp from said connecting member is detected by said discharge-lamp disconnection detecting means.

7. A lighting circuit for a discharge lamp, having a first connection determination terminal, said lighting circuit comprising:

ignition means for supplying a trigger pulse to said discharge lamp;

lighting control means for controlling lighting of said discharge lamp and said ignition means; and a connecting member, connected to said lighting control means, having power supply terminals to which power supply terminals of said discharge lamp are connected and a second connection determination terminal;

wherein said second connection determination terminal is connected to said first connection determination terminal such that said discharge lamp is connected to said connecting member, and wherein power supply to said discharge lamp and supply of said trigger pulse to said discharge lamp are inhibited when said first and second connection determination terminals are not connected together.

8. A lighting circuit for a discharge lamp, having a first connection determination terminal, said lighting circuit comprising:

ignition means for supplying a trigger pulse to said discharge lamp;

lighting control means for controlling lighting of said discharge lamp and said ignition means;

a connecting member, connected to said lighting control means, having power supply terminals to which power supply terminals of said discharge lamp are connected and a second connection determination terminal;

wherein said first and second connection determination terminals are connected to each other while said discharge lamp is connected to said connecting member; and discharge-lamp disconnection detecting means for detecting when said discharge lamp is connected to said connecting member in accordance with a connection state of said first and second connection determination terminals, wherein power supply to said discharge lamp and supply of said trigger pulse to said discharge lamp are inhibited when disconnection of said discharge lamp from said connecting member is detected by said discharge-lamp disconnection detecting means.

* * * * *